US007350266B2

(12) United States Patent
Park et al.

(10) Patent No.: US 7,350,266 B2
(45) Date of Patent: Apr. 1, 2008

(54) UPRIGHT TYPE VACUUM CLEANER

(75) Inventors: Jung-seon Park, Gwangju (KR); Hyung-il Jeon, Gwangju (KR)

(73) Assignee: Samsung Gwangju Electronics Co., Ltd., Gwangju (KR)

( * ) Notice: Subject to any disclaimer, the term of this patent is extended or adjusted under 35 U.S.C. 154(b) by 687 days.

(21) Appl. No.: 10/851,245

(22) Filed: May 24, 2004

(65) Prior Publication Data

US 2004/0261219 A1 Dec. 30, 2004

(30) Foreign Application Priority Data

Jun. 26, 2003 (KR) ..... 10-2003-0042065

(51) Int. Cl.
*A47L 9/32* (2006.01)

(52) U.S. Cl. ..... 15/410

(58) Field of Classification Search ..... None
See application file for complete search history.

(56) References Cited

U.S. PATENT DOCUMENTS

| | | | |
|---|---|---|---|
| 4,423,534 | A | 1/1984 | Lyman et al. |
| 4,823,430 | A | 4/1989 | Yonkers et al. |
| 6,006,401 | A | 12/1999 | Jailor et al. |

FOREIGN PATENT DOCUMENTS

| | | | |
|---|---|---|---|
| GB | 481679 | A | 3/1938 |
| GB | 2384694 | A | 8/2003 |
| JP | 2000-041926 | | 2/2000 |

OTHER PUBLICATIONS

Combined Search and Examination Report under Sections 17 and 18(3) dated Oct. 21, 2004.

Canadian Patent Office, Office Action dated Sep. 6, 2006, with respect to Canadian Patent Application No. 2,471,992, filed on Jun. 22, 2004.

*Primary Examiner*—David A Redding
(74) *Attorney, Agent, or Firm*—Blank Rome LLP

(57) ABSTRACT

An upright type vacuum cleaner has a locking to selectively restrain the pivoting of a handle assembly when the handle assembly is pivoted to be in a right angle with respect to a base. The locking device includes a locking portion disposed at a side of the base, a locking protrusion movably disposed at the handle assembly and selectively moving between a locking position where the locking protrusion contacts with the locking portion and an unlocking position where the locking protrusion releases out of the locking portion, and a pedal member pivotably disposed at the handle assembly to move the locking protrusion. As the pedal member is disposed at the handle assembly, the size of the base can be reduced and the manipulation of the pedal member becomes easy.

13 Claims, 7 Drawing Sheets

UPRIGHT TYPE VACUUM CLEANER

REFERENCE TO RELATED APPLICATION

This application claims priority to copending Korean Patent Application No. 2003-42065, filed Jun. 26, 2003 in the Korean Intellectual Property Office, which is incorporated herein by reference in its entirety.

FIELD OF THE INVENTION

The present invention generally relates to a vacuum cleaner. More specifically, the invention relates to an upright type vacuum cleaner having a locking device which restrains a handle assembly from rotating to a predetermined angle, with the handle assembly being rotatably connected to a base.

BACKGROUND OF THE INVENTION

Conventional upright type vacuum cleaners include a base which moves on a surface to be cleaned and has a suction port at a lower part, and a handle assembly rotatably connected to the base. The handle assembly includes a vacuum generator, a dust collecting device, and a handle. Also, the upright type vacuum cleaner usually includes a locking device which lessens a user's fatigue cause by the weight of the handle assembly during operation of the vacuum cleaner. When the vacuum cleaner is not operating, the locking device prevents the handle assembly from inadvertently rotating due to its weight and maintains the vacuum cleaner in a fixed position. The locking device selectively restrains the relative rotation of the handle assembly and the base when the handle assembly is at a predetermined angle with respect to the base.

Referring to FIG. 1, a locking device of the conventional upright type vacuum cleaner 100 includes a locking protrusion 140, a pedal protrusion 154, and a pedal member 150.

The locking protrusion 140 is formed at the handle assembly 110 and disposed adjacent to a hinge shaft 115 which is rotatably connected the base 130. As seen in FIG. 1, the locking protrusion 140 is defined by an upper wall of a locking recess 141 formed in a side of the handle assembly 110.

The pedal member 150 is pivotably disposed at the base 130 so as to pivot on a rotary shaft 152 and has the pedal protrusion 154 extending from a side thereof. The pedal protrusion 154 engages and disengages the locking recess 141 as the pedal member 150 rotates. That is, the pedal protrusion 154 is selectively locked with the locking protrusion 140. An elastic body 155 is also provided to allow the elastic pivot of the pedal member 150.

A problem with the conventional vacuum cleaner 100 having the pedal member 150 disposed at the base 130 is that the width A of a rear of the base 130 is very broad. Also, operation of the vacuum cleaner is inconvenient, particularly when manipulating the pedal member 150, since the pedal member 150 is disposed at the side of the base 130 instead of at the rear of the base 130 where the feet of the user are usually located.

SUMMARY OF THE INVENTION

Accordingly, an object of the present invention is to provide an upright type vacuum cleaner having an improved locking device which allows a reduced sized base and easy manipulation of a pedal member.

To achieve the above aspect of the present invention, the upright type vacuum cleaner includes a base having a suction port therein through which contaminants are drawn in from a surface to be cleaned, a handle assembly rotably connected to the base, and a locking device that fixes the handle assembly with respect to the base when the handle assembly and the base are at a predetermined angle. The locking device includes a locking portion disposed at a side of the base and a locking protrusion movably disposed on the handle assembly. The locking device is selectively movable between a locked position when the locking protrusion contacts the locking portion and an unlocked position when the locking protrusion is released from the locking portion. A pedal member is pivotably disposed at the handle assembly to move the locking protrusion.

Because the pedal member is disposed at the handle assembly, the size of the base is reduced. Also, because the pedal member is located at the lower end of the rear side of the handle assembly, a user can conveniently manipulate the pedal member.

According to a preferred embodiment, the locking device includes a slider having a slider body slidably disposed on the handle assembly and a locking protrusion extending from a side of the slider body. A first cam member is disposed at the pedal member and a second cam member is disposed at a side of the slider corresponding to the first cam member to move the slider by contact with the first cam member while the pedal member pivots.

The pedal member is disposed at a rear part of the handle assembly facing the user performing the cleaning operation. The first and second cam members respectively have an inclined surface corresponding to each other so as to move the slider toward the unlocked position when the pedal member pivots downward.

The handle assembly includes a vacuum cleaner body having a vacuum generator, a dust collecting device, and an auxiliary handle formed at a side thereof, and a handle frame pivotably connected to the base to removably receive the vacuum cleaner body. The suction port is in fluid communication with the vacuum generator of the vacuum cleaner body when the vacuum cleaner body is received in the handle frame.

The handle frame includes a base frame having a receiving portion formed on an upper side thereof and a lower end pivotably connected to the base. The receiving portion is removably received in the vacuum cleaner body. A central frame extends from the base frame and has a central portion cut off in a predetermined shape to surround an outer surface of the vacuum cleaner body to be received in the receiving portion. A handle is formed at a side of the central frame. Preferably, the base frame, the central frame, and the handle are integrally formed.

The handle assembly and the base includes a pair of first hinge portions extending from the base in a predetermined interval, a pair of second hinge portions formed by recessing a lower end of the handle frame to cover an outer surface of the first hinge portions, respectively, when the handle assembly is connected to the base, and a hinge shaft rotatably connected to the first and second hinge portions. A wheel may be rotatably disposed at the outer side of the second hinge portions.

The receiving portion includes a mounting recess at which the pedal member is pivotably disposed and slidably receives the slider. The second hinge portion has a first through hole formed in a side thereof, through which the locking protrusion goes in and out of when the slider disposed in the mounting recess moves.

The locking device includes an elastic member disposed at the mounting recess to elastically bias the slider toward the locked position. When the handle assembly pivots with respect to the base, the locked protrusion moves in contact with the outer surface of the first hinge portion, and when the handle assembly and the base are positioned at a predetermined angle, the locking protrusion contacts with the locking portion and prevents the handle assembly from pivoting with respect to the base.

A release prevention protrusion is formed extending from a connecting portion of the slider body and the locking protrusion, to prevent the slider body from escaping the handle assembly through the first through hole when the slider moves.

The locking device includes a cover member disposed in the receiving portion to cover an open upper part of the mounting recess to prevent the slider and the pedal member from escaping from the mounting recess. The cover member includes a through hole to guide the pivoting of the pedal member.

One locking portion is formed at the connecting portion, and at least one of the locking portions is locked with the locking protrusion when the handle assembly is at a right angle with respect to the base.

BRIEF DESCRIPTION OF THE DRAWINGS

These and other aspects and advantages of the invention will become apparent and more readily appreciated from the following description of the embodiments, taken in conjunction with the accompanying drawings.

DETAILED DESCRIPTION OF THE PREFERRED EMBODIMENT

Hereinafter, a preferred embodiment of the present invention will be apparent in greater detail with reference to the annexed drawings.

Figure 1:
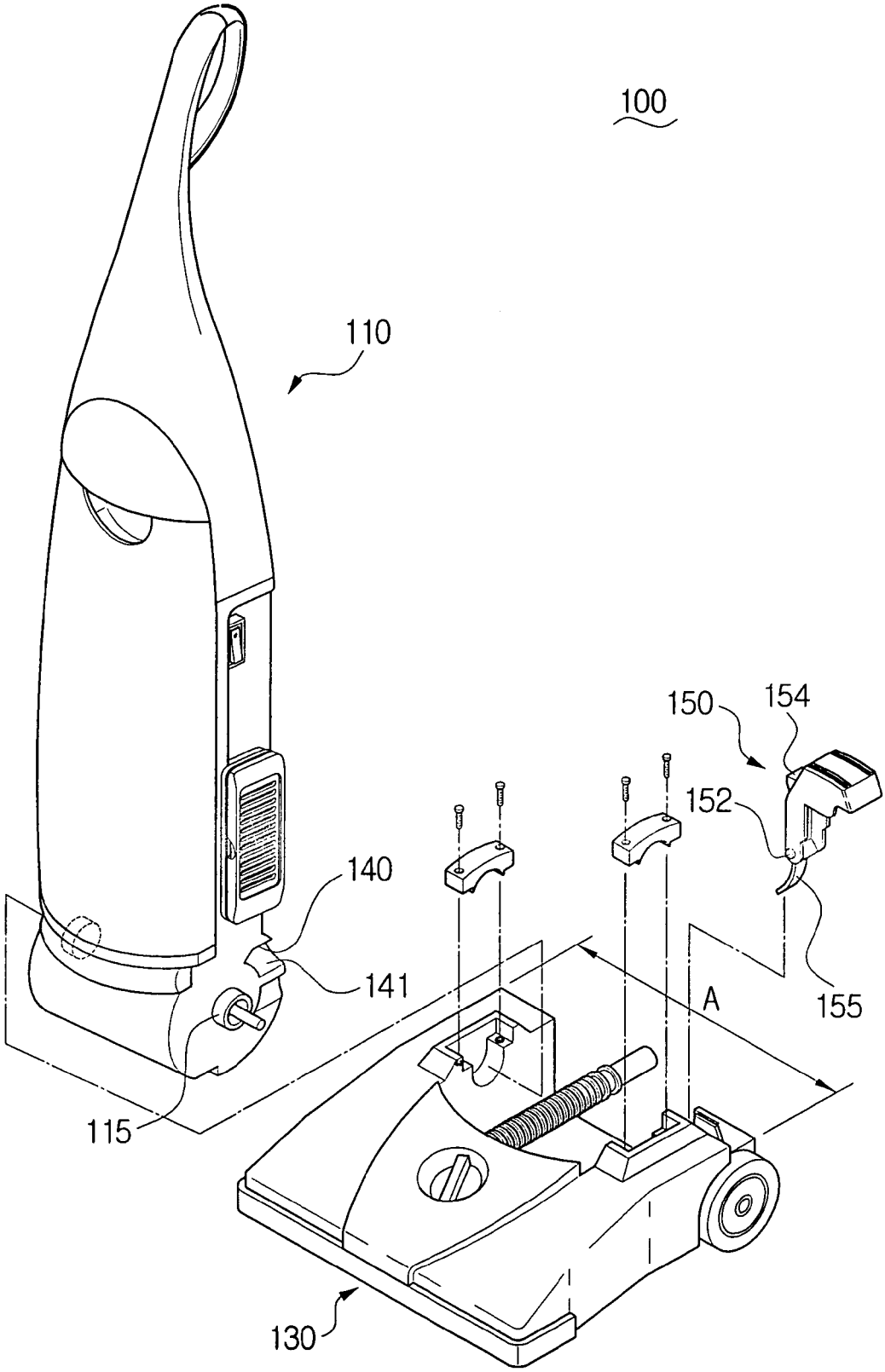
FIG. 1 (PRIOR ART)
FIG. 1 is an exploded perspective view of a conventional upright type vacuum cleaner.
Figure 2:
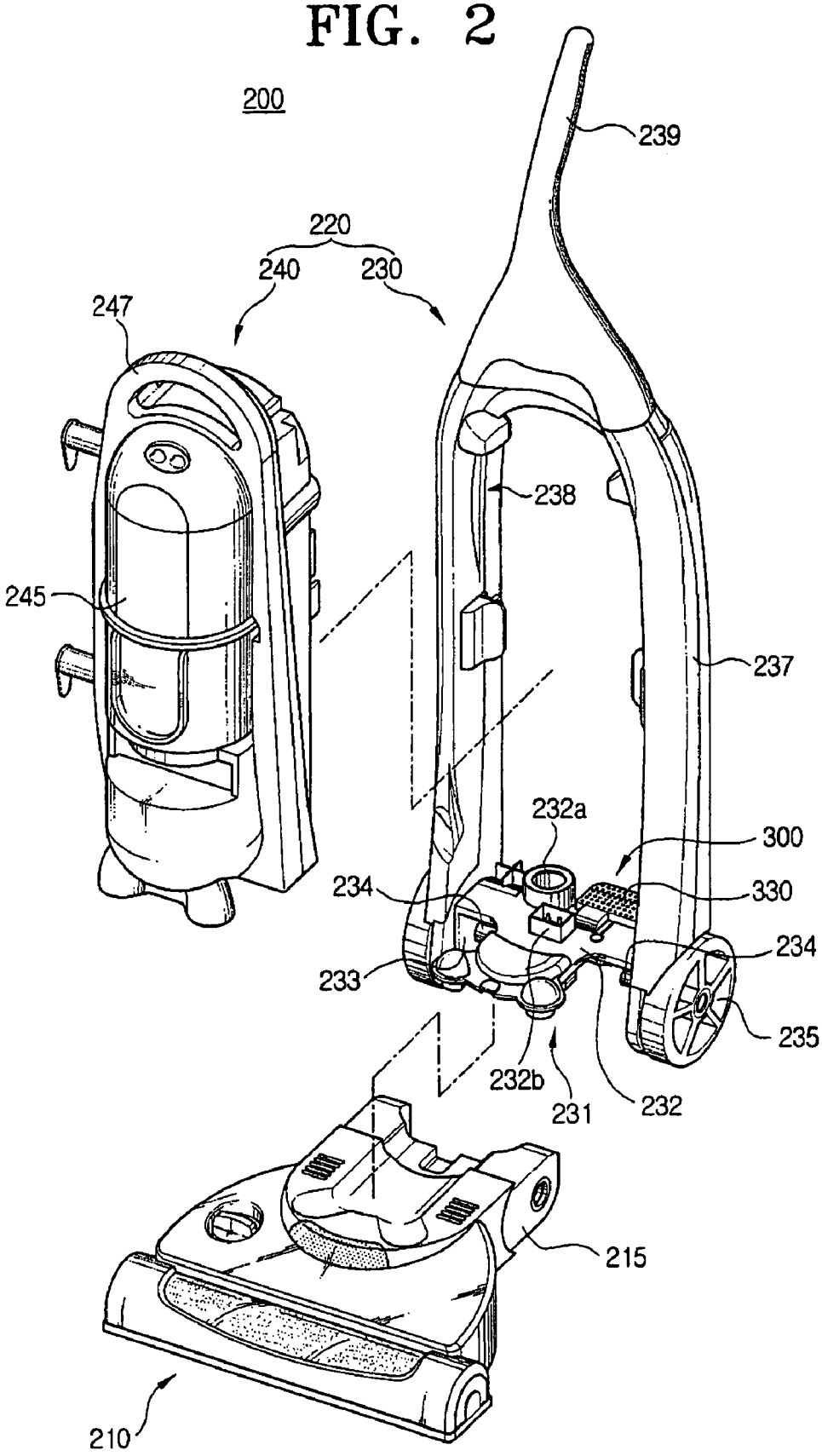
FIG. 2 is an exploded perspective view of an upright type vacuum cleaner according to a an embodiment of the present invention.
Figure 3:
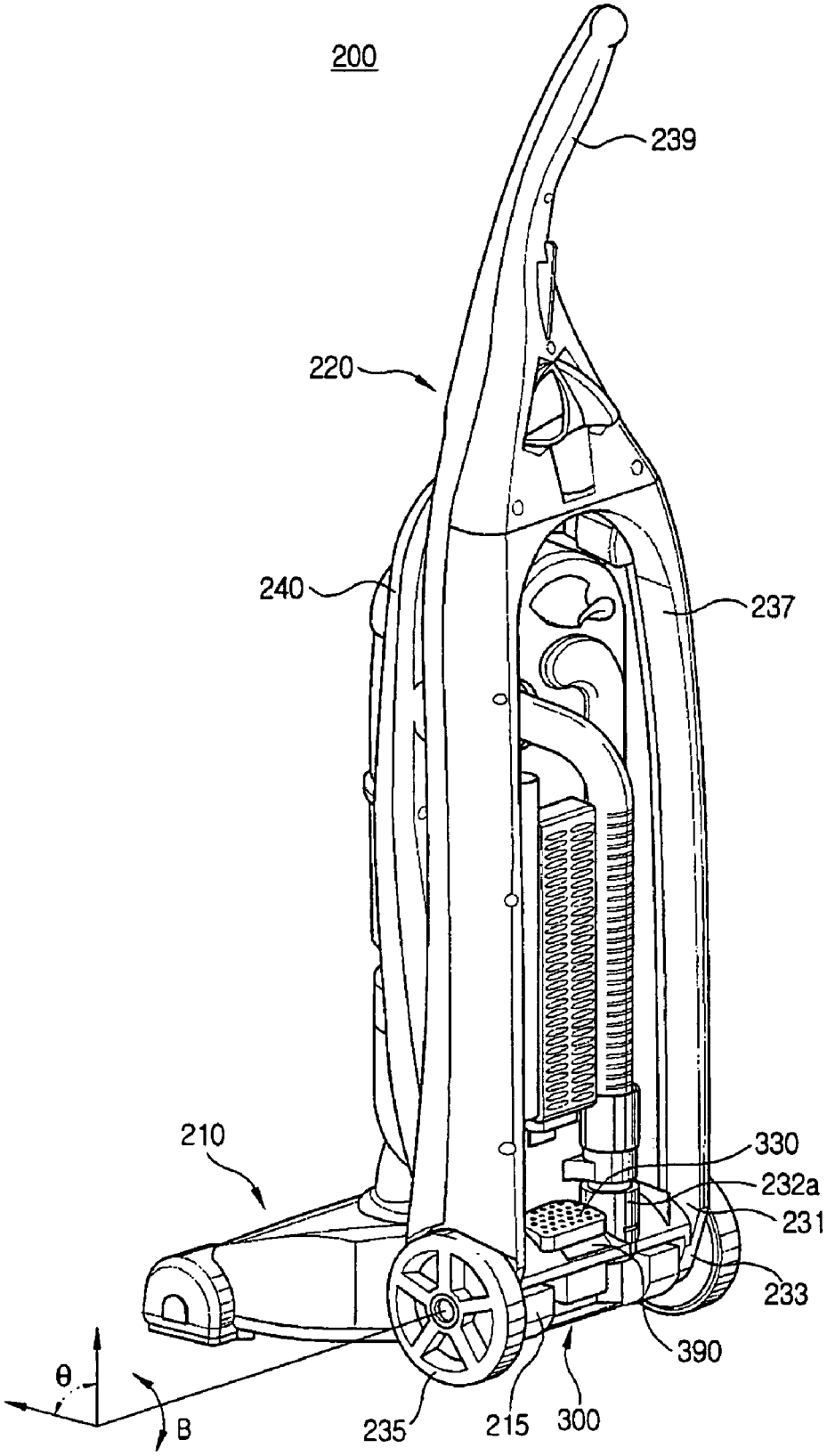
FIG. 3 is a rear perspective view of the upright type vacuum cleaner illustrated in FIG. 2 after assembly.
Figure 4:
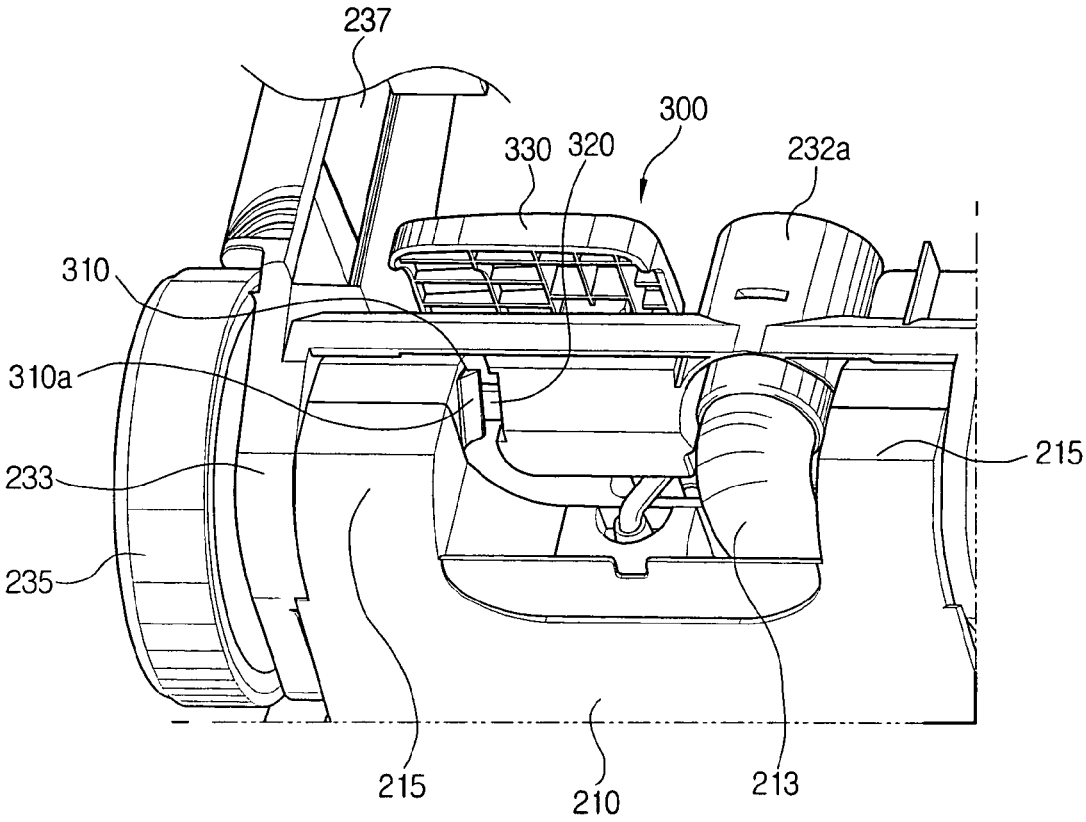
FIG. 4 is a partial perspective view of the upright type vacuum cleaner illustrated in FIG. 3.
Figure 5:
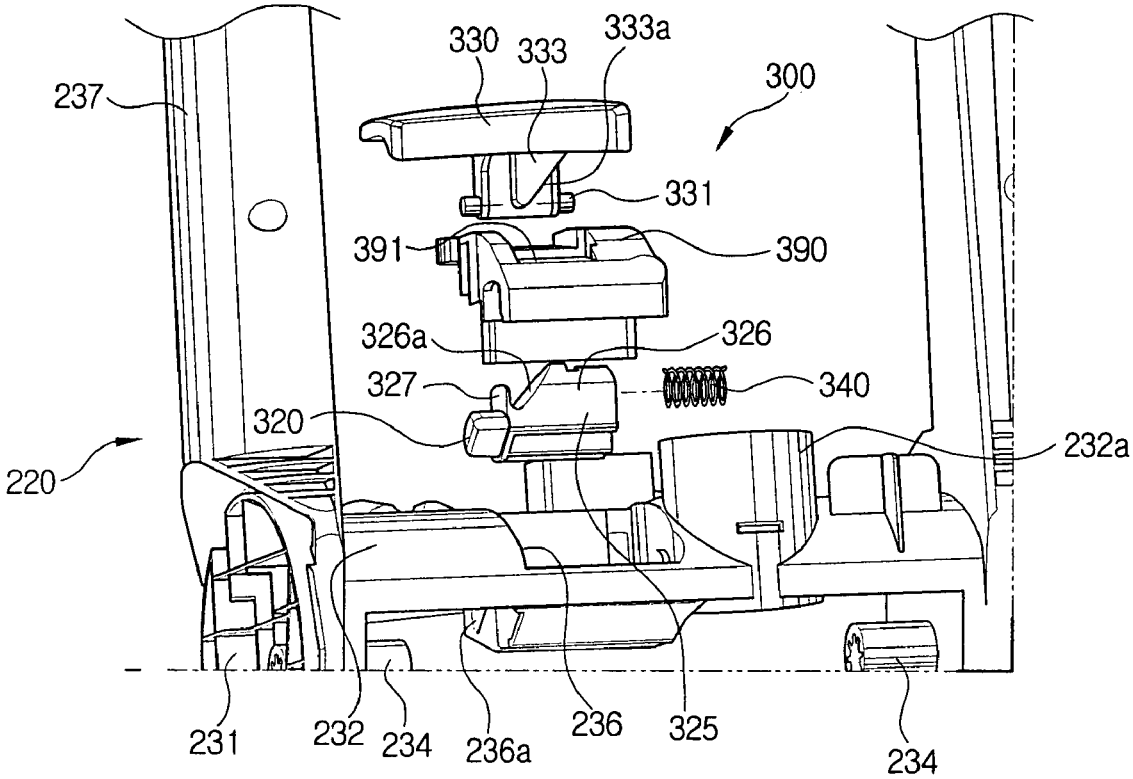
FIGS. 5 and 6 are exploded partial perspective views of the upright type vacuum cleaner illustrated in FIG. 3, showing a locking device of the vacuum cleaner.

Referring to FIGS. 2 to 4, an upright type vacuum cleaner 200 according to the preferred embodiment of the present invention includes a base 210, a handle assembly 220, and a locking device 300.

The base 210 has a suction port (not shown) formed at a bottom side facing a surface to be cleaned to draw in contaminants from the surface. A hose 213 of FIG. 4 connects the suction port of the base 210 with the handle assembly 220 for fluid communication there between.

The handle assembly 220 is connected to the base 210 and rotates relative thereto in a direction of B in FIG. 3, and includes a vacuum generator (not shown), a dust collecting device 245, and a handle 239. The handle assembly 220 also includes a handle frame 230 and a vacuum cleaner body 240. The vacuum cleaner body 240 is removably connected to the handle frame 230 and includes the vacuum generator and the dust collecting device 245.

The vacuum cleaner body 240 includes the vacuum generator (not shown) and the dust collecting device 245 which are in fluid communication with the suction port when the vacuum cleaner body 240 is mounted in the handle frame 230. At a side of the vacuum cleaner body 240, an auxiliary handle 247 is disposed for a user to grip while operating the vacuum cleaner body 240 when it is detached from the handle frame 230. Hence, with the vacuum cleaner body 240 connected to the handle assembly 220, the cleaning operation is performed through the suction port of the base 210. With the vacuum cleaner body 240 detached from the handle assembly 220, the cleaning operation is performed by connecting another suction port assembly (not shown) of the vacuum cleaner body 240 to the vacuum generator and the dust collecting device 245 providing fluid communication therebetween. Since the vacuum generator and the dust collecting device 245 have configurations like those of the conventional vacuum cleaner, a detailed description thereof will be omitted.

The handle frame 230 includes a base frame 231, a central frame 237, and a handle 239. Preferably, the base frame 231, the central frame 237, and the handle 239 are integrally formed.

On a top side of the base frame 231, a receiving portion 232 is formed on which the vacuum cleaner body 240 is mounted. A bottom side of the base frame 231 is rotatably connected to the base 210. A connecting pipe 232*a* connects the hose 213 with the vacuum cleaner body 240 mounted on the receiving portion 232. A terminal part 232*b* electrically connects the base 210 with the vacuum cleaner body 240 mounted on the receiving portion 232.

The base frame 231 and the base 210 are connected to each other by a pair of first hinge portions 215, a pair of second hinge portions 233, and a pair of hinge shafts 234. The first hinge portions 215 protrude from a rear part of the base 210 at a predetermined distance from each other. The second hinged portions 233 extend from a lower part of the base frame 231 and form recess corresponding to the first hinge portions 215. The hinge shaft 234 protrudes from the second hinge portions 233 to rotatably connect the first and second hinge portions 215 and 233. When assembled, the outer surface of the first hinge portions 215 are surrounded by the second hinge portions 233 and are not exposed outside of the vacuum cleaner 200. Hence, to form the central frame 237, the base 210 does not have to have a large size to accommodate the enlarged size of the handle assembly 220. In addition, a wheel 235 may be disposed at an outer wall of the second hinge portions 233 to allow easier manufacture of the base 210.

The central frame 237 is connected to an upper part of the base frame 231 and has a central opening 238 that receives the vacuum cleaner body 240 with body 240 being mounted on the receiving portion 232. The handle 239 is connected to an upper part of the central frame 237.

The vacuum cleaner 200 includes a locking device 300 to prevent the rotation of the handle assembly 220 with respect to the base 210 when the handle assembly 220 and the base 210 are positioned at a predetermined angle θ. This conveniently maintains the handle assembly 220 in a fixed position when not operating the vacuum cleaner 200. The handle assembly 220 is usually connected to the base 210 in a substantially perpendicular arrangement.

As shown in FIGS. 4 to 7, the locking device 300 includes a locking portion 310, a locking protrusion 320, and a pedal member 330. The locking protrusion 320 and the pedal member 330 are disposed on the handle assembly 220.

The locking portion 310 is formed at a circumference of the first hinge portion 215 of the base 210. The locking portion 310 may be formed in various shapes and numbers. For example, the locking portion 310 may be formed as a recess as in the conventional vacuum cleaner or as an extension as in the present invention. The locking portion 310 is preferably formed at a location where the locking portion 310 can lock with the locking protrusion 320 when the handle assembly 220 and the base 210 form a right angle.

Figure 6:
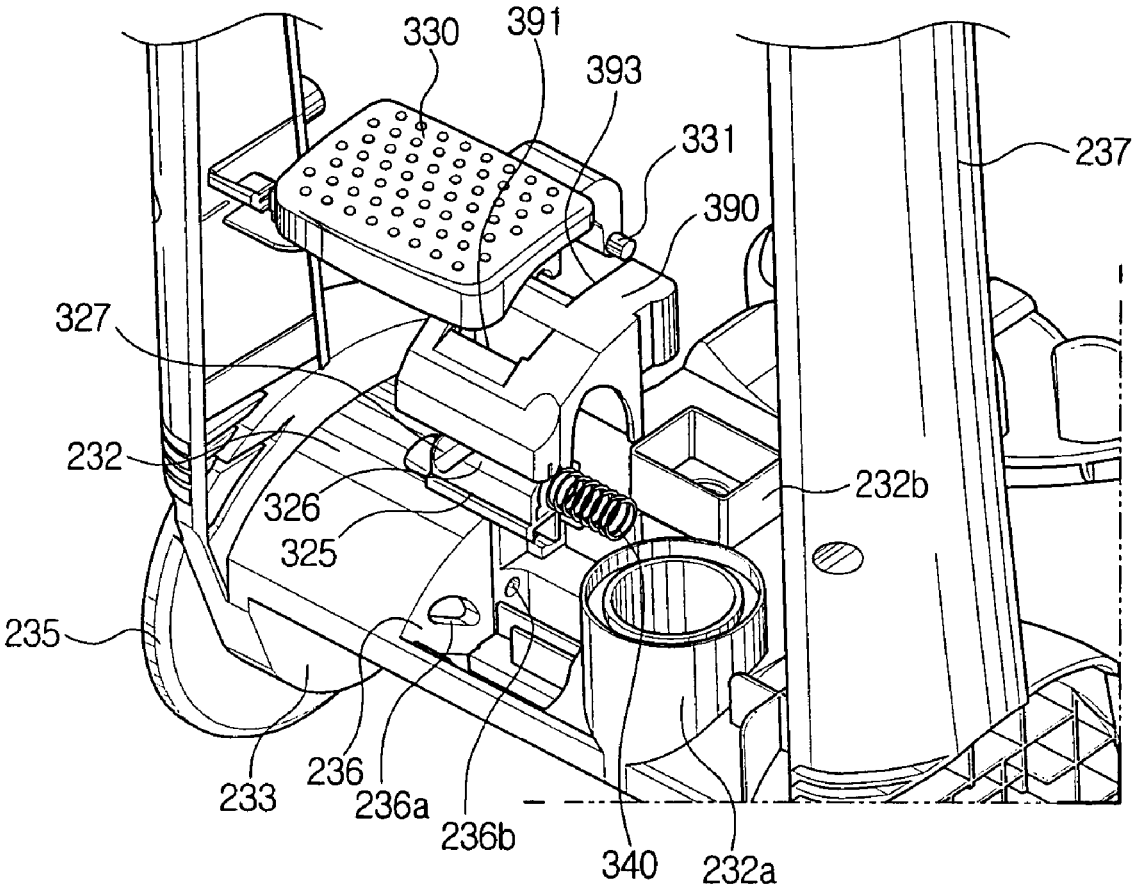
Figure 7:
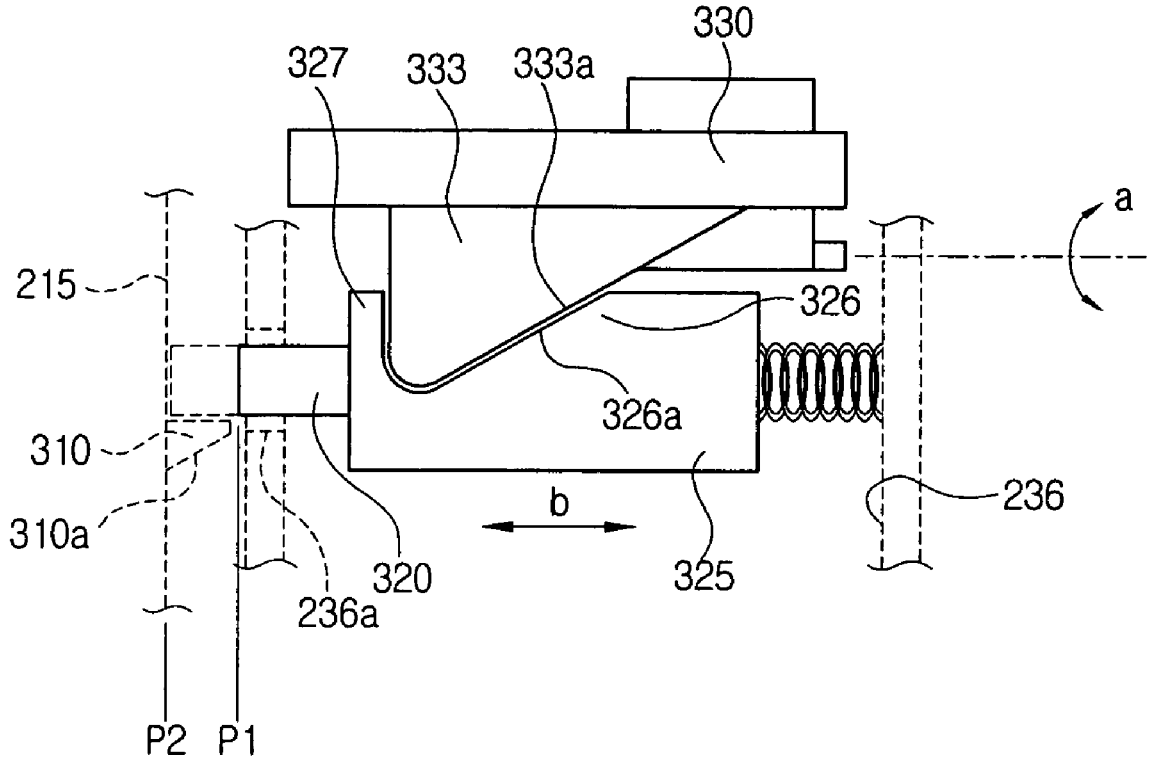
FIG. 7 is a view schematically showing the operation of the locking device of the upright type vacuum cleaner according to an embodiment of the present invention.

The locking protrusion 320 is disposed at the base frame 231 so that the locking protrusion 320 can move between a locked position P2 and an unlocked position P1 of FIG. 7. In the locked position P2, the locking protrusion 320 contacts the locking portion 310 through a first through hole 236*a* (FIG. 6) which is disposed in the second hinge portion 233. In the unlocked position P1, the locking protrusion 320 is released from the locking portion 310.

The pedal member 330 is disposed at the base frame 231 and vertically pivots about rotary shaft 331, so as to selectively move the locking protrusion 320. Preferably, the pedal member 330 is positioned at a rear part of the handle assembly 220 which faces the user performing the cleaning operation and gripping the handle 239. The pedal member 330 is conveniently positioned adjacent to the foot of the user. By locating the pedal member 330 in the handle assembly 220 instead of in the base 210, base 210 can be made smaller.

To move the locking protrusion 320 using the pedal member 330, the locking device 300 includes a slider 325, first and second cam members 333 and 326, and a spring 340.

The slider 325 is slidably disposed at a mounting recess 236 formed in the base frame 231 with the locking protrusion 320 protruding from an end of the slider 325. On a sidewall of the mounting recess 236, the first through hole 236*a* is formed. When the slider 325 slides in the mounting recess 236, the locking protrusion 320 penetrates through the first through hole 236*a* and selectively contacts the circumference of the first hinge portion 215. A release prevention protrusion 327 prevents the slider 325 from moving through the first through hole 236*a* due to the biasing force of the spring 340 which will be described later, and limits the operating range of the first and second cam members 333 and 326.

The first and second cam members 333 and 326 protrude from the outer surfaces of the pedal member 330 and the slider 325 respectively. When the cam members 333 and 326 contact each other, the slider 325 is moved in a direction of B (FIG. 7) in association with the pivoting A of the pedal member 330 (FIG. 7). The first and second cam members 333 and 326 may be configured in various shapes, as long as the cam members 333 and 326 can move the slider 325 in association with the pivoting pedal member 330. The first and second cam members 333 and 326 have inclined surfaces 333*a* and 326*a*, respectively, formed to lead the locking protrusion 320 to the unlocked position P1 when the pedal member 330 pivots downward.

The spring 340 is disposed in the mounting recess 236 to elastically urge the slider 325 toward the first hinge portion 215. Unless the user manipulates the pedal member 330, due to the elastic recovery force of the spring 340, the locking protrusion 320 remains in the first through hole 236*a* and in contact with the first hinge portion 215. While the locking protrusion 320 is in contact with an outer wall of the first hinge portion 215, if the handle assembly 220 is rotated a predetermined distance to the base 210 at a right angle with respect to the base 210, the locking protrusion 320 is caught by the locking portion 310 to restrain the downward pivoting of the handle assembly 220. To facilitate locking operation of the locking protrusion 320 and the locking portion 310, it is preferred that one of the locking protrusion 320 and the locking portion 310 has an inclined surface 310*a* (FIG. 4).

The locking device 300 further includes a cover member 390 disposed in the receiving portion 232 covering an upper opening of the mounting recess 236. While the pedal member 330 pivots, the cover member 390 seals the upper opening of the mounting recess 236 except for a second through hole 391 and a third through hole 393 (FIG. 6). The first cam member 333 goes in and out of the second through hole 391, and the third through hole 393 prevents interference with the pivoting of the pedal member 330. The cover member 390 prevents the spring 340 and the slider 325 from coming out of the mounting recess 236, and also prevents foreign substances from flowing into the mounting recess 236.

While the preferred embodiment of the present invention has been described, it is not limited to the upright type vacuum cleaner having the locking device 300 which includes the pedal member 330, the slider 325, and the spring 340. Hence, the locking device 300 may be configured in various shapes, as long as the locking device 300 can selectively lock the pivoting of the handle assembly 220 at a predetermined location and a manipulating portion for the lock is disposed at the handle assembly 220.

As aforementioned, the pedal member 330 is disposed at the handle assembly 220 to reduce the size of the base 210. Even if the size of the handle assembly 220 is enlarged due to the formation of the central frame 237, the size of the base 210 can be maintained uniformly.

Also, since the pedal member 330 is disposed at the lower end of the rear part of the handle assembly 220, the user can conveniently manipulate the pedal member 330.

It will be appreciated by those skilled in the art that changes and modifications may be made to the present invention without departing from the principles and spirit of the invention.

What is claimed is:

1. An upright type vacuum cleaner comprising:

a base having a suction port therein through which contaminants are drawn in from a surface to be cleaned and a locking portion formed thereon;

a handle assembly connected to the base to relatively rotate with respect to the base, the handle assembly including a locking protrusion movably disposed therein and selectively movable between a locked position where the locking protrusion contacts with the locking portion and an unlocked position where the locking protrusion releases out of the locking portion; and a locking device adapted to fix the handle assembly with respect to the base when the handle assembly and the base are at a predetermined angle, and the locking device including, the locking portion, the locking protrusion, and a pedal member pivotably disposed at the handle assembly to move the locking protrusion between the locked and unlocked positions.

2. The upright type vacuum cleaner of claim 1, wherein the locking device includes a slider including a slider body slidably disposed on the handle assembly and the locking protrusion protruding from a side of the slider body;

a first cam member disposed on the pedal member; and a second cam member disposed on a side of the slider corresponding to the first cam member to move the slider by contact with the first cam member while the pedal member pivots.

3. The upright type vacuum cleaner of claim 2, wherein the pedal member is disposed at a rear part of the handle assembly facing a user performing the cleaning operation, and the first and second cam members, respectively, have an inclined surface corresponding to each other so as to move the slider toward the unlocked position when the pedal member pivots downward.

4. The upright type vacuum cleaner of claim 3, wherein the handle assembly includes a vacuum cleaner body having a vacuum generator, a dust collecting device, and an auxiliary handle formed at a side thereof; and a handle frame pivotably connected to the base to removably receive the vacuum cleaner body, and the suction port is in fluid communication with the vacuum generator of the vacuum cleaner body when the vacuum cleaner body is received in the handle frame.

5. The upright type vacuum cleaner of claim 4, wherein the handle frame includes a base frame having a receiving portion formed on an upper side thereof, and a lower end of the base frame being pivotably connected to the base, the receiving portion removably receiving the vacuum cleaner body;

a central frame extending from the base frame and having a central opening shaped to surround an outer surface of the vacuum cleaner body to be received in the receiving portion; and a handle formed at a side of the central frame.

6. The upright type vacuum cleaner of claim 5, wherein a pair of first hinge portions extend from the base at a predetermined interval;

a pair of second hinge portions formed by recessing a lower end of the handle frame to cover an outer surface of the first hinge portions, respectively, when the handle assembly is connected to the base; and a hinge shaft to rotatably connect the first and second hinge portions.

7. The upright type vacuum cleaner of claim 6, wherein the receiving portion includes a mounting recess at which the pedal member is pivotably disposed and slidably receives the slider; and the second hinge portion has a first through hole formed in a side thereof, through which the locking protrusion moves in and out upon movement of the slider disposed in the mounting recess.

8. The upright type vacuum cleaner of claim 7, wherein the locking device includes an elastic member disposed at the mounting recess to elastically bias the slider toward the locking position, and when the handle assembly pivots with respect to the base, the locking protrusion moves in contact with the outer surface of the first hinge portion, and when the handle assembly and the base are positioned at a predetermined angle, the locking protrusion contacts with the locking portion and prevents the handle assembly from pivoting with respect to the base.

9. The upright type vacuum cleaner of claim 8, wherein a release prevention protrusion is formed extending from the slider body and the locking protrusion, to prevent the slider body from escaping to the outside of the handle assembly through the first through hole when the slider moves.

10. The upright type vacuum cleaner of claim 7, wherein the locking device includes a cover member disposed in the receiving portion to cover an upper opening of the mounting recess to prevent the slider and the pedal member from escaping from the mounting recess, and the cover member includes a through hole to guide the pivoting of the pedal member.

11. The upright type vacuum cleaner of claim 6, wherein a wheel is rotatably disposed at an outer side of each of the second hinge portions of the handle frame.

12. The upright type vacuum cleaner of claim 6, wherein at least one locking portion is formed at a circumference of one of the first hinge portions, and one of the locking portions is locked with the locking protrusion when the handle assembly is at a right angle with respect to the base.

13. The upright type vacuum cleaner of claim 5, wherein the base frame, the central frame, and the handle are integrally formed.

* * * * *